US005960645A

United States Patent [19]

Sangiacomo

[11] Patent Number: 5,960,645

[45] Date of Patent: Oct. 5, 1999

[54] DEVICE FOR SELECTING NEEDLES IN CIRCULAR STOCKING KNITTING MACHINES

[75] Inventor: Fulvio Sangiacomo, Brescia, Italy

[73] Assignee: Sangiacomo S.p.A., Brescia, Italy

[21] Appl. No.: 09/093,014

[22] Filed: Jun. 5, 1998

[51] Int. Cl.[6] ..... D04B 15/66

[52] U.S. Cl. ..... 66/13; 66/216

[58] Field of Search ..... 66/8, 16, 13, 215, 66/216, 217, 218, 219, 221, 222, 223, 224, 225, 226, 227, 25.2, 116, 123

[56] References Cited

U.S. PATENT DOCUMENTS

| | | | |
|---|---|---|---|
| 2,032,324 | 2/1936 | Lawson et al. | 66/222 |
| 3,971,233 | 7/1976 | Amaya et al. | 66/222 |
| 5,174,131 | 12/1992 | Cottenceau et al. | 66/222 |
| 5,367,893 | 11/1994 | Fucik | 66/216 |

FOREIGN PATENT DOCUMENTS

| | | | |
|---|---|---|---|
| 684844 | 7/1940 | Germany | 66/222 |
| 536262 | 7/1977 | U.S.S.R. | 66/222 |

*Primary Examiner*—John J. Calvert
*Assistant Examiner*—Larry D. Worrell, Jr.
*Attorney, Agent, or Firm*—McGlew and Tuttle, P.C.

[57] ABSTRACT

A device for the selection of needles in circular stocking knitting machines, comprising a lower needle (or jack) having radial deflection for each needle on the cylinder of the said machine. Selection actuators are provided for the control of the lower needles. Each lower needle includes two components: an element oscillating between an inoperative position and the operating, vertically movable position in order to control the corresponding needle and to follow the courses of upward and downward movement cams; and a toothed element which is arranged facing the oscillating element, capable of oscillations with same, but prevented from moving vertically. The toothed element always remains at the level of the selection actuators even when the oscillating element moves vertically.

12 Claims, 2 Drawing Sheets

DEVICE FOR SELECTING NEEDLES IN CIRCULAR STOCKING KNITTING MACHINES

FIELD OF THE INVENTION

The present invention pertains, in general, to circular stocking knitting machines, and it pertains, more specifically, to a device for selecting needles in circular machines for knitting products having multiple yarns and different colors.

BACKGROUND OF THE INVENTION

In the field of the stocking knitting machines the needles are selected by means of the selection actuators arranged around the cylinder of the machine and intended to control the lower needles (or jacks) with radial deflection in order to control their passage by oscillation between an operating, deflected position and an inoperative, released position.

The lower needles have selection teeth at various levels and the selection actuators, which are electromagnetic or another type, comprise levers, which are able to intercept these selection teeth when the lower needles must be deflected and arranged in the operating position, and which are able not to interfere with these teeth when the lower needles must remain in the inoperative position.

In the operating position and as the cylinder rotates, the lower needles, forced by their lifting heel, follow the upward and downward courses defined by the stationary cams arranged around the cylinder. Therefore, the lower needles, rising, control the corresponding needles on the cylinder directly or indirectly by means of pushers and then return to a lowered position for a next selection.

According to the known embodiments, the selection teeth are integral with the lower needles and invariably follow all the upward and downward movements of the respective lower needles, and thus they also carry out vertical movements in relation to the selection actuators, which always remain stationary and at the same level.

Such a system does have some drawbacks which experts in the art know: for example, the difficulty in always obtaining and in making the level of the teeth coincide with that of the selection levers so that they are able to interact in a correct manner, the spaces necessary for the upward and downward movements of the lower needles which have a negative effect on the position of the selection actuators, as well as the number of the selection stations around the cylinder especially in multi-feed and multi-yarn knitting machines, etc.

SUMMARY AND OBJECTS OF THE INVENTION

However, the primary object of the present invention is to propose a device for selecting needles in circular stocking knitting machines, in which the selection teeth of the lower needles always remain at the same level, without, i.e., being moved vertically even when the lower needles carry out the respective upward and downward movements.

Another object of the present invention is to provide a device for the selection of needles in circular stocking knitting machines that is able, if not to eliminate, to reduce the drawbacks of the traditional systems, therefore with the possibility of a greater interaction precision between the selection teeth and the actuators, to reduce the spaces for the upward and downward movements of the lower needles, and to be able to increase the selection points equal to the space around the cylinder.

According to the invention, a device is provided for selecting the needles in circular stocking knitting machines comprising a lower needle (or jack) having radial deflection for each needle on the cylinder of the machine. Selection actuators are arranged around the cylinder and are intended to control the lower needles to control their oscillation between a released inoperative position and a deflected operating position. The lower needles have selection teeth, and the selection actuators have deflection levers, which are able to intercept these teeth only when the lower needles have to move into the operating position. The lower needles have a deflection heel which is intended to follow a track with upward and downward movement cams, and in which the operating selection of the corresponding needles corresponds to the upward movement of the lower needles. Each lower needle is formed of two components: an element which oscillates between the inoperative position and the operating and vertically movable position so as to control the corresponding needle and to follow the courses of the upward and downward movement cams; and a toothed element that is arranged facing the said oscillating element, which is capable of oscillations with same, but is prevented from moving vertically. The toothed element always remains at the level of the selection actuators even when the oscillating element moves vertically.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 2:
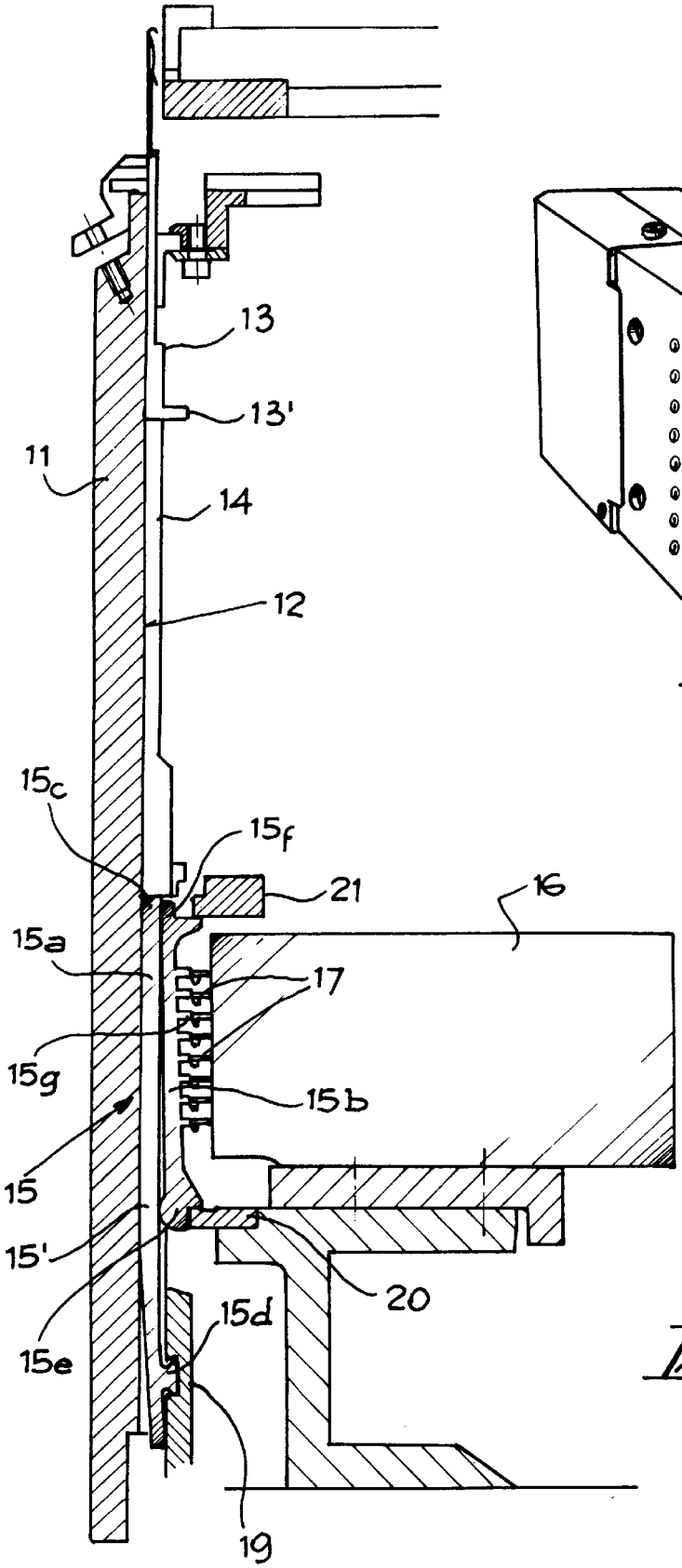
FIG. 2 is a sectional view showing the inoperative positions, respectively of the selection device.

Referring to the drawings in particular, the cylinder of a circular machine is indicated by 11. The cylinder 11 has on its periphery a plurality of longitudinal grooves 12 (see FIG. 2), in each of which are arranged, aligned and sliding, a needle 13, an optional pusher 14, and a lower needle or jack 15 to lift the needle 13 or to lift the needle 13 by means of the pusher 14, if this pusher 14 is present.

At least the needle 13 has a heel 13', and it is controlled for the upward and downward movement, in the known manner, by means of cams (not shown), which drive the heel 13'.

Figure 3:
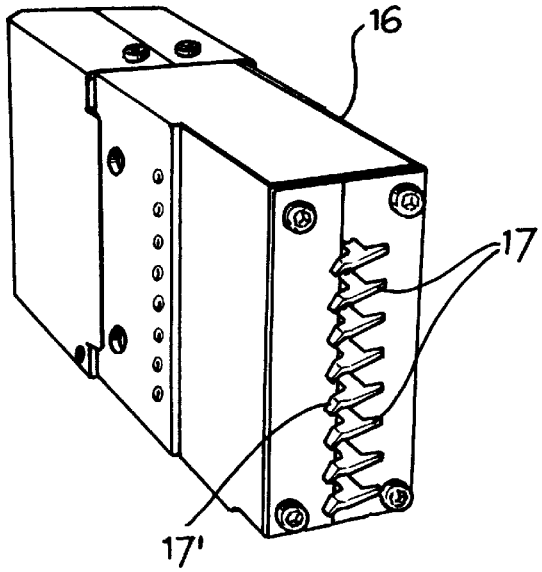
FIG. 3 is a perspective view showing an example of a selection actuator.

The lower needle 15 is of the deflection type and is able to oscillate in the corresponding groove 12 on an intermediate fulcrum 15' between an operating position and an inoperative position. The oscillations of the lower needle 15 are controlled by selection actuators 16 which are arranged around the cylinder and have selection levers 17 (see FIG. 3). These selection levers 17 are intended to deflect the lower needles in the operating position and then to release them, so that they may return to the original position having been deflected in such a direction by press-jack cams.

According to the present invention and to the embodiment illustrated here, each lower needle 15 consists of two components: an oscillating and vertically movable element 15*a* and a toothed element 15*b*, which always remains at the same level, without ever moving vertically.

The oscillating element 15*a* bears the oscillation fulcrum 15', which rests on the bottom of the groove 12, and has, on the top, a terminal 15*c* intended to interact with the needle 13 in order to deflect it, when it is selected and, on the bottom, a heel 15*d* which is, in its turn, intended to cooperate with upward and downward movement cams 19 arranged around the cylinder when the lower needle is in its operating position.

Figure 1:
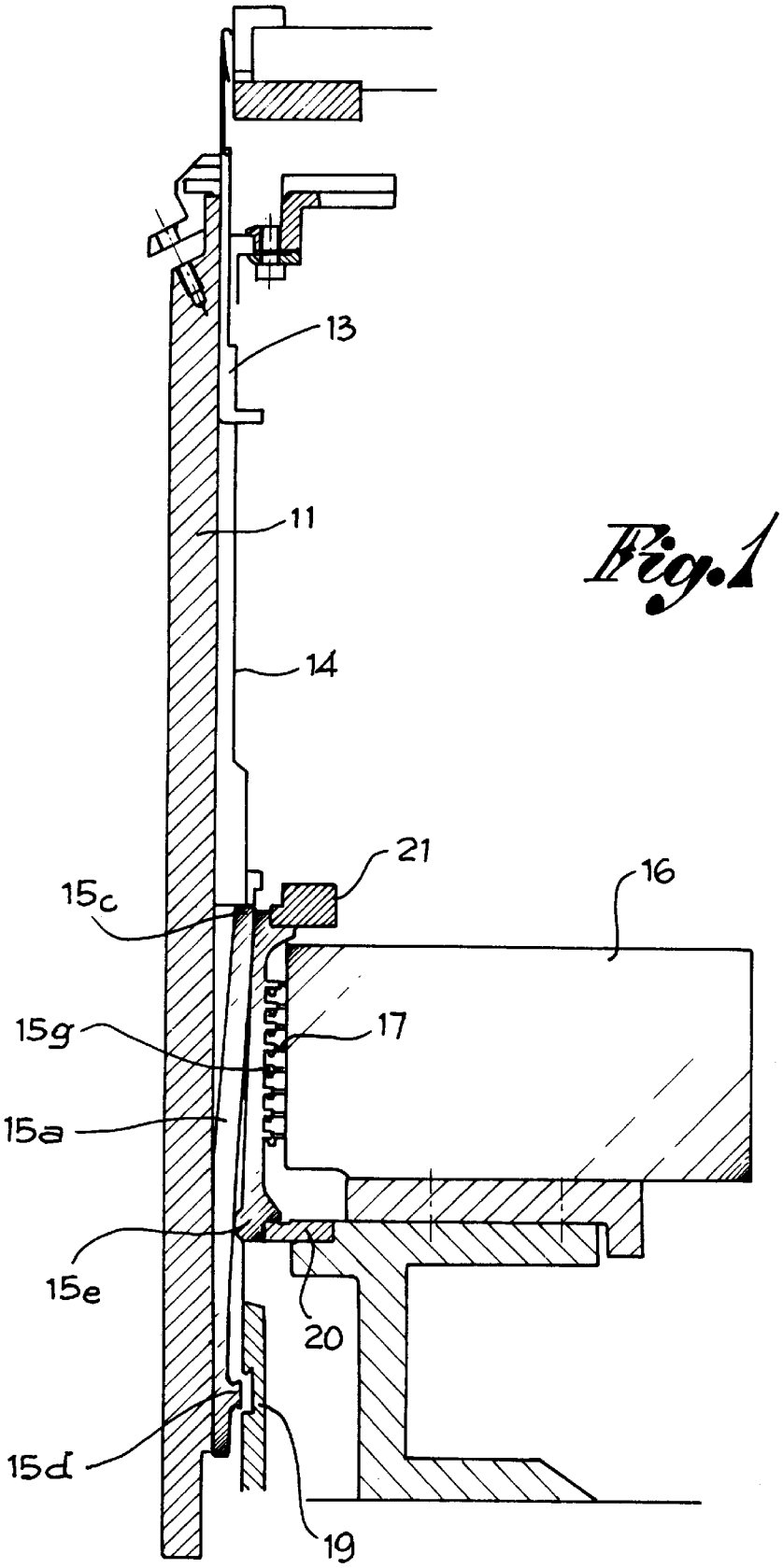
FIG. 1 is a sectional view showing the operating position of the selection device.

Advantageously, the heel 15*d* of the lower needle has a dovetail shape (cf. FIGS. 1, 2) and the upward and downward movement cams 19 define a guide track, whose cross section has a shape similar to that of the heel 15*d*. In this manner the heel remains forced in said guide track to keep the lower needle reliably in the operating position during its movements, with the heel being released by the guide track only in correspondence to inlet and outlet passages.

The toothed element 15*b* is arranged facing the oscillating element 15*a* and extends upwards from the level of the fulcrum 15' up to approximately the tip of said oscillating element. The toothed element 15*b* rests behind the oscillating element in at least two parts 15*e* and 15*f* and is supported externally between a lower ring 20 and an upper ring 21 which act as means for preventing vertical movement of the toothed elements 15*b*. In practice the toothed element 15*b* is able to oscillate with the oscillating element 15*a*, but it is prevented from moving vertically. In other words, it always remains at the same level even when the oscillating element 15*a* is controlled by the upward and downward movement cams 19 for its vertical movements.

The toothed element 15*b* is provided with teeth 15*g*, which are intended to interact with the deflection levers 17 of the selection actuators 16. Since the toothed element 15*b* does not move vertically, its teeth 15*g* always remain at the level of the selection levers 17 without related movements with respect to these, and thus, once the toothed element 15*b* has been set in position, the condition of interaction between teeth and selection levers no longer changes.

Moreover, each selection lever 17 of the selection actuators 16 (see FIG. 3) has a terminal portion 17' that is inclined downwards to prevent interference with the selection teeth during the operation of the machine with reciprocating motion when the teeth, in their return, might knock against the levers and break them.

The inclined portion eliminates this possibility; therefore, the levers 17 in contact with the teeth 15*g* are, in fact, lowered without intercepting them and allow them to pass freely.

While a specific embodiment of the invention has been shown and described in detail to illustrate the application of the principles of the invention, it will be understood that the invention may be embodied otherwise without departing from such principles.

What is claimed is:

1. A selection device for selecting needles in circular stocking knitting machines with a cylinder, the device comprising:

a lower needle having radial deflection for each needle on the cylinder of the circular stocking knitting machine;

selection actuators arranged around the cylinder for control of each said lower needle to control lower needle oscillation between a released inoperative position and a deflected operating position, each said lower needle having selection teeth, said selection actuators having deflection levers for intercepting said selection teeth only when said lower needle has to move into said operating position, each said lower needle having a deflection heel for following a track with upward and downward movement cams and in which an operating selection of corresponding needles corresponds to the upward movement of said lower needle, each said lower needle being formed of:

an oscillating element which oscillates between said inoperative position and said operating and vertically movable position so as to control the corresponding needle and to follow courses of the upward and downward movement cams; and a toothed element with said selection teeth, said toothed element being arranged facing said oscillating element and capable of oscillations with same, wherein said selection device includes means for preventing said toothed element from moving vertically, with said toothed element always remaining at a level of said selection actuators even when the said oscillating element moves vertically.

2. The selection device in accordance with claim 1, wherein said oscillating element has an oscillation fulcrum and has, on a top, a terminal which is intended to interact directly or indirectly with a corresponding needle and, on a bottom, a lifting heel cooperating with the upward and downward movement cam track when said lower needle is in the operating position.

3. The selection device in accordance with claim 2, wherein said lifting heel has a dovetail shape, and the upward and downward movement cam track has a dovetail section corresponding to that of said heel.

4. The selection device in accordance with claim 1, wherein said toothed element rests on the front of said oscillating element with at least two parts and is supported vertically between two said lower and upper rings.

5. The selection device in accordance with claim 4, wherein said toothed element has said selection teeth turned towards and coplanar with deflection levers of said selection actuators.

6. The selection device in accordance with claim 5, wherein said deflection levers have a terminal bent and inclined downwards.

7. A circular stocking knitting machine selection device for selecting needles, the device comprising:

upward and downward movement cams;

a lower needle which is radially deflectable, a lower needle being provided for selection of each needle on the cylinder of the circular stocking knitting machine, each said lower needle including an oscillating element which oscillates between an inoperative position and an operating and vertically movable position so as to control the corresponding needle and to follow courses of said upward and downward movement cams and a toothed element with selection teeth, said toothed element being arranged facing said oscillating element, said toothed element being capable of oscillating with said oscillating element, said selection device including means for preventing said toothed element from moving vertically, each said lower needle having a deflection heel for following a track of said upward and downward movement cams and in which an operating selection of corresponding needles corresponds to the upward movement of said lower needle;

selection actuators arranged around the cylinder for control of each said lower needle to control lower needle oscillation between said released inoperative position and said deflected operating position, said selection actuators having deflection levers for intercepting said selection teeth only when said lower needle has to move into said operating position, said toothed element always remaining at a level of said selection actuators even when the said oscillating element moves vertically.

8. The selection device in accordance with claim 7, wherein said oscillating element has an oscillation fulcrum and has, on a top, a terminal which is intended to interact directly or indirectly with a corresponding needle and, on a bottom, a lifting heel cooperating with the upward and downward movement cam track when said lower needle is in the operating position.

9. The selection device in accordance with claim 8, wherein said lifting heel has a dovetail shape, and the upward and downward movement cam track has a dovetail section corresponding to that of said heel.

10. The selection device in accordance with claim 7, wherein said toothed element rests on the front of said oscillating element with at least two parts and is supported vertically between two said lower and upper rings.

11. The selection device in accordance with claim 10, wherein said toothed element has said selection teeth turned towards and coplanar with deflection levers of said selection actuators.

12. The selection device in accordance with claim 11, wherein said deflection levers have a terminal bent and inclined downwards.

* * * * *